US011479984B2

(12) United States Patent
DeLeu

(10) Patent No.: US 11,479,984 B2
(45) Date of Patent: Oct. 25, 2022

(54) MASON LINE FASTENER

(71) Applicant: Douglas DeLeu, Vandalia, MI (US)

(72) Inventor: Douglas DeLeu, Vandalia, MI (US)

( * ) Notice: Subject to any disclaimer, the term of this patent is extended or adjusted under 35 U.S.C. 154(b) by 333 days.

(21) Appl. No.: 16/825,163

(22) Filed: Mar. 20, 2020

(65) Prior Publication Data

US 2021/0293039 A1 Sep. 23, 2021

(51) Int. Cl.
*E04G 21/18* (2006.01)

(52) U.S. Cl.
CPC ..... *E04G 21/1825* (2013.01)

(58) Field of Classification Search
CPC ..... E04G 21/1825; E04G 21/1808; B65H 2701/353
See application file for complete search history.

(56) References Cited

U.S. PATENT DOCUMENTS 765,250 A 7/1904 McPherson
1,594,836 A 8/1926 Ingram
2,559,697 A * 7/1951 Anders ..... E04G 21/1825 33/409
3,200,500 A * 8/1965 Stone ..... E04G 21/1825 D10/61
3,408,742 A * 11/1968 Caprio ..... E04G 21/1825 D10/61
3,555,688 A * 1/1971 Smathers ..... E04G 21/1825 33/408
4,456,291 A * 6/1984 Brogie ..... E05C 19/004 292/338
5,290,124 A * 3/1994 Pavlescak ..... B63C 15/00 405/3
6,370,817 B1 * 4/2002 Brooks ..... A01G 17/04 24/19
6,412,184 B1 * 7/2002 Heavner ..... G01C 15/00 33/409
7,409,771 B2 * 8/2008 Bond ..... B65H 75/406 33/409
7,673,393 B1 * 3/2010 Hudson ..... G01C 15/12 33/408

(Continued)

FOREIGN PATENT DOCUMENTS

EP 399961 A * 11/1990 ..... E04G 21/1825
GB 1433191 A * 4/1976 ..... E04G 21/1825

(Continued)

OTHER PUBLICATIONS

Spear & Jackson Solid Rubber Lime Green Line Block, Bunnings Warehouse, Mar. 27, 2018.

*Primary Examiner* — Ryan D Kwiecinski
(74) *Attorney, Agent, or Firm* — The Dobrusin Law Firm, PC

(57) ABSTRACT

A mason line fastener includes first and second adjacent outer edges forming a first corner having an outer angle. A first inner surface and second inner surface intersect to form an inner angle. The inner angle is offset from the first outer angle. The first inner surface includes a groove that extends along at least a portion of its length and through the second inner surface and through the second outer edge. A mason line may be wound around a portion of the mason line fastener and threaded through the groove and held taut when placed in connection with a block.

12 Claims, 5 Drawing Sheets

(56) References Cited

U.S. PATENT DOCUMENTS

| | | | | | |
|---|---|---|---|---|---|
| 7,779,546 | B2 * | 8/2010 | Bond | ..... | G01C 15/02 33/409 |
| 8,291,606 | B2 * | 10/2012 | Miller | ..... | E04G 21/1825 33/409 |
| 2007/0029433 | A1 * | 2/2007 | Bond | ..... | E04G 21/1825 33/409 |

FOREIGN PATENT DOCUMENTS

| | | | | | |
|---|---|---|---|---|---|
| GB | 2258689 | A * | 2/1993 | ..... | E04G 21/1825 |
| GB | 2261251 | A * | 5/1993 | ..... | E04G 21/1825 |
| WO | WO-2005028779 | A1 * | 3/2005 | ..... | E04G 21/1825 |

* cited by examiner

MASON LINE FASTENER

FIELD OF INVENTION

The present invention relates to a string line for alignment work in carpentry, mason and general construction, specifically for use with radiused masonry corners.

BACKGROUND

Mason walls are made of stone, block, or brick laid in stacked horizontal rows known as courses. To ensure that the courses are properly aligned vertically and horizontally in an intended location, a mason may begin assembly of a wall by building opposing corners of the mason wall. The mason may then set a mason's line to define the outer edge of the wall.

Various designs for mason's line holders and fasteners have been developed. Most designs comprise a steel pin, such as a pin that is about four inches in length. The pin may be driven into the mortar at the top of the wall and the line may be pulled tight between the corners. However, moving this type of line may be cumbersome because inserting the line into the mortar each time is time consuming and may cause inaccurate positioning.

Other designs of mason line fasteners have been developed that do not rely on inserting a pin into the brick. One example of this type of line holder or fastener 10 is illustrated in FIG. 1. The holder 10 includes an opening 12 configured to receive a corner of a brick or block therein. While the illustrated line holder 10 is usable in applications having sharp cornered bricks, it fails to function on walls that utilize bricks, blocks, or stones having radiused corners, as are typically used in construction of schools, hospitals, etc. for safety reasons. In particular, the illustrated line holder is not able to retain a hold on a radiused block corner when the line is pulled taut, and may not provide a secure hold.

Accordingly, an improved mason line fastener is needed.

SUMMARY

A mason line fastener is generally presented. The mason line fastener may be configured to connect to a corner of a block and hold a mason line in a desired location relative to a wall to be built. The mason line fastener may include a first outer edge and a second outer edge adjacent to and forming a first outer angle with the first outer edge at a first corner. The mason line fastener may further include a first inner surface and second inner surface, intersecting the first inner surface and forming an inner angle with the first inner surface. The inner angle may be offset from the first outer angle. The first inner surface may include a groove that extends along at least a portion of its length and through the second inner surface and through the second outer edge.

In an embodiment, the mason line fastener may include a slot adjacent to the groove. The slot may extend through the second inner surface and the second outer edge. The slot may bisect the second inner surface and the second outer edge. The mason line fastener may include a second groove located in the second outer edge, the second groove may connect to the groove.

The mason line fastener may include a third groove extending around the first corner. The mason line fastener may further include a triangular groove in the first outer edge where one side of the triangular groove is shared with the third groove.

In an embodiment, a method of using a mason line fastener includes providing a mason line fastener. The mason line fastener may comprise a first outer edge and a second outer edge adjacent to and forming a first corner having a first outer angle with the first outer edge. The mason line may further include a first inner surface and second inner surface forming an inner angle, where the inner angle is offset from the first outer angle. The mason line fastener may further include a groove in the first inner surface, where the groove extends from an intersection between the first inner surface and the first outer edge through the second inner surface and through the second outer edge. The method of using the mason line fastener may further include the steps of: positioning the first inner surface and second inner surface against adjacent sides of a block; providing a mason line and winding the mason line around a portion of the mason line fastener; and positioning the mason line within the groove.

BRIEF DESCRIPTION OF THE DRAWINGS

The operation of the invention may be better understood by reference to the detailed description taken in connection with the following illustrations, wherein.

DETAILED DESCRIPTION

Figure 1:
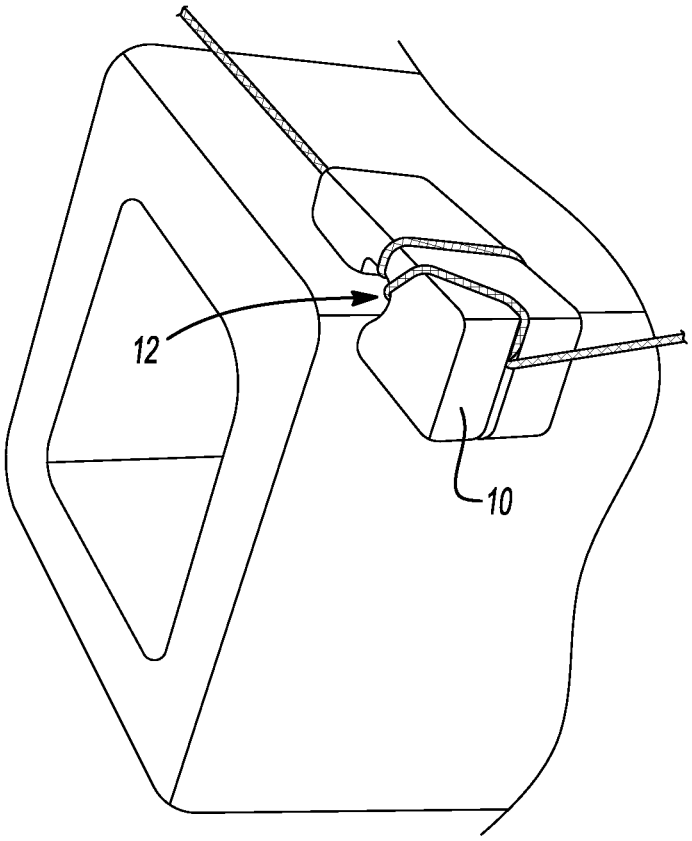
Fig-1 (Prior Art)
FIG. 1 illustrates a prior art mason line fastener.
Figure 2:
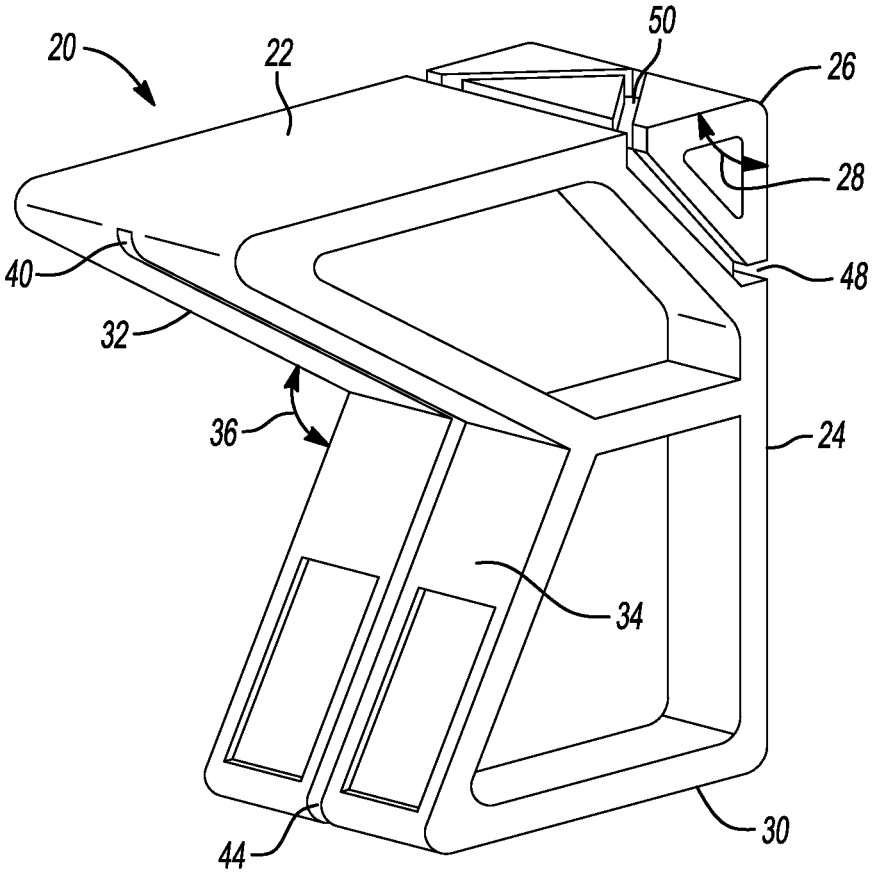
FIG. 2 illustrates a front perspective view of a mason line fastener.
Figure 3:
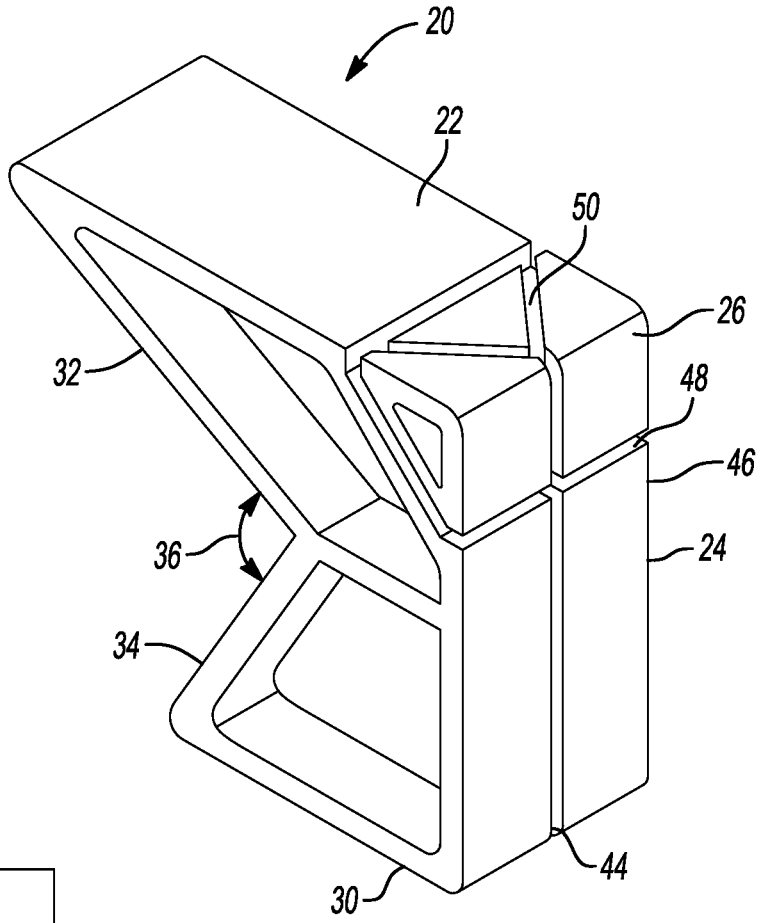
FIG. 3 illustrates a rear perspective view of a mason line fastener.
Figure 4:
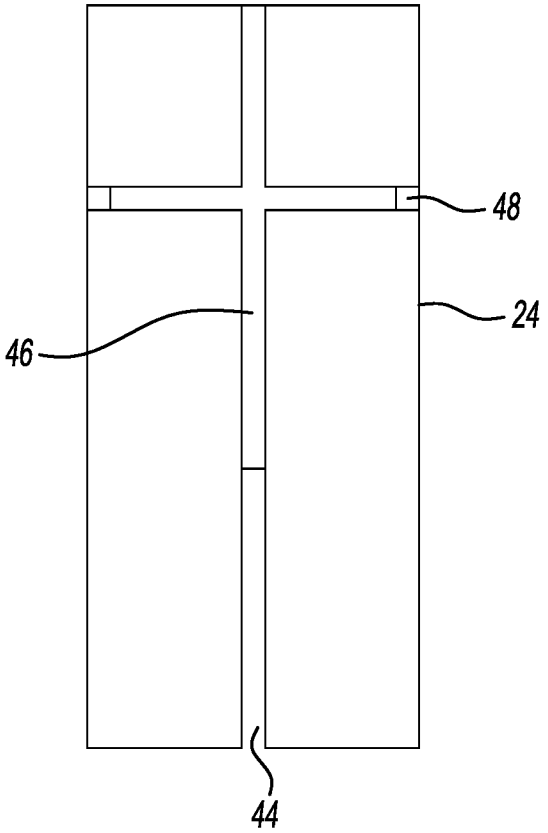
FIG. 4 illustrates rear view of a mason line fastener showing the slot and a second groove.
Figure 5:
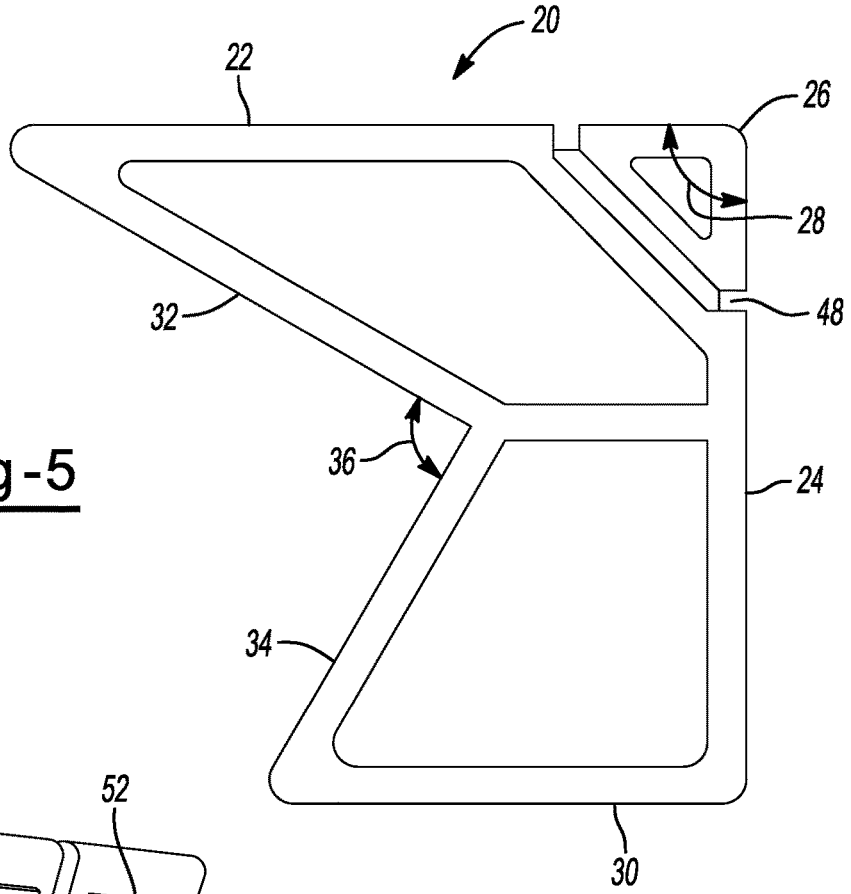
FIG. 5 illustrates a side view of a mason line fastener showing the corner groove.
Figure 6:
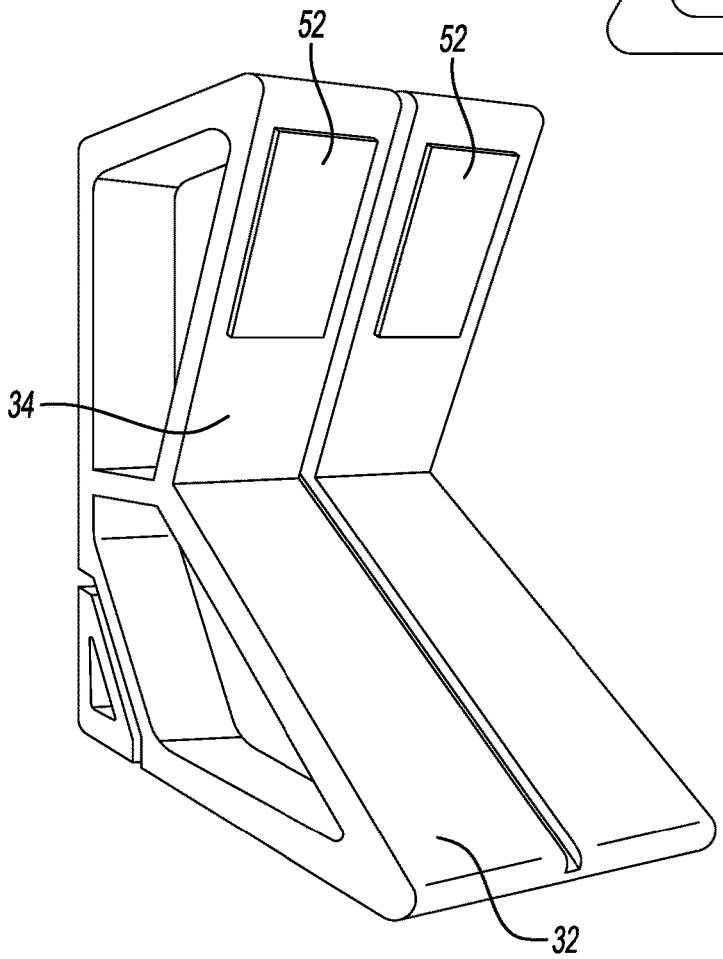
FIG. 6 illustrates a side perspective view of a mason line fastener having two non-slip pads on a second inner surface.
Figure 7:
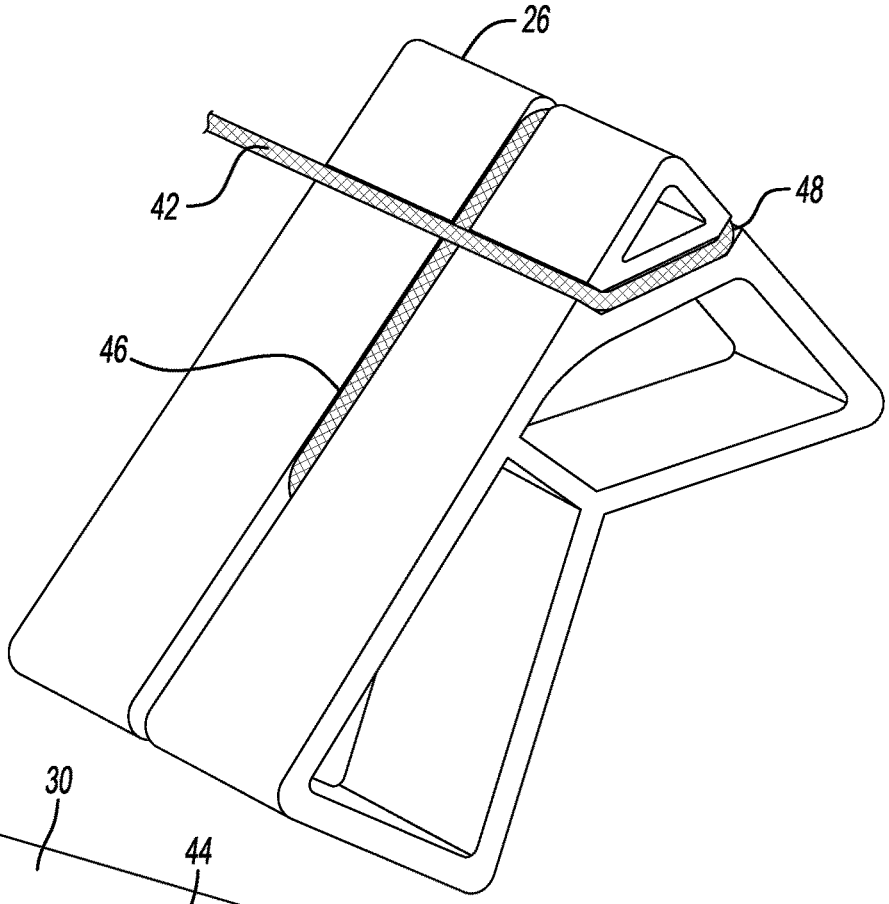
FIG. 7 illustrates a mason line wound around a corner groove and positioned in the outer groove of a mason line fastener.
Figure 8:
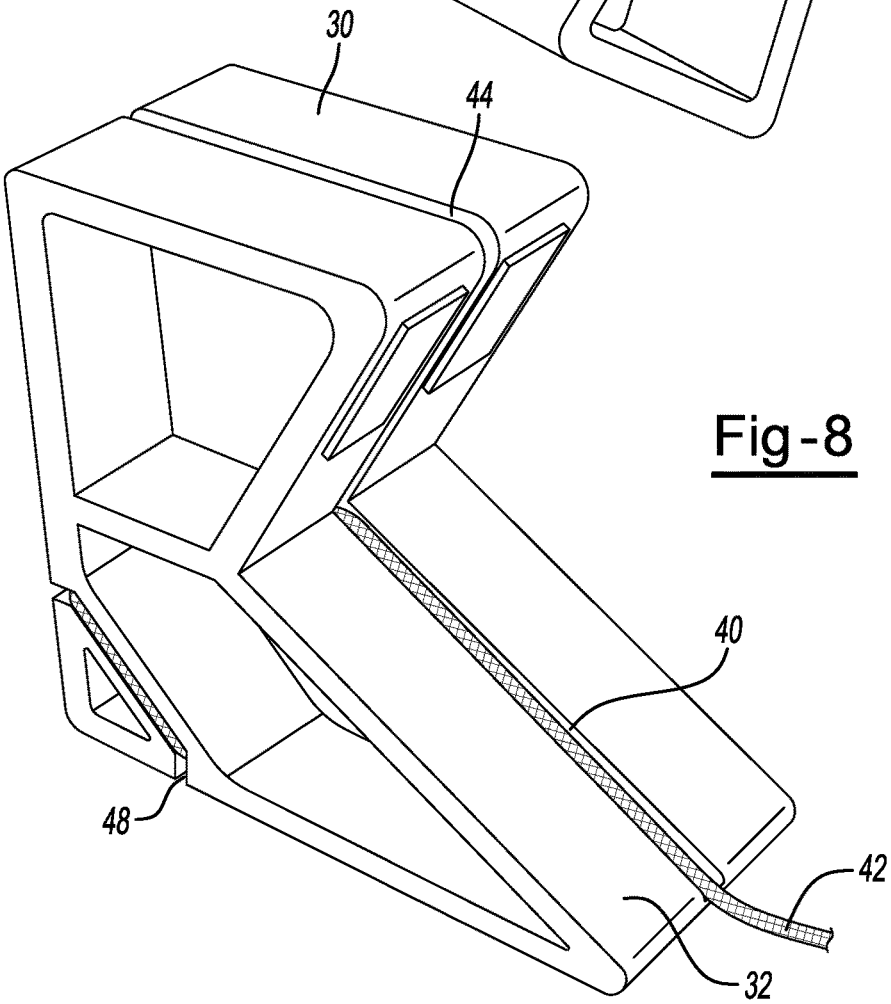
FIG. 8 illustrates a perspective view of a mason line fastener having a mason line wound around the corner groove and extending through the slot and inserted into the groove.
Figure 9:
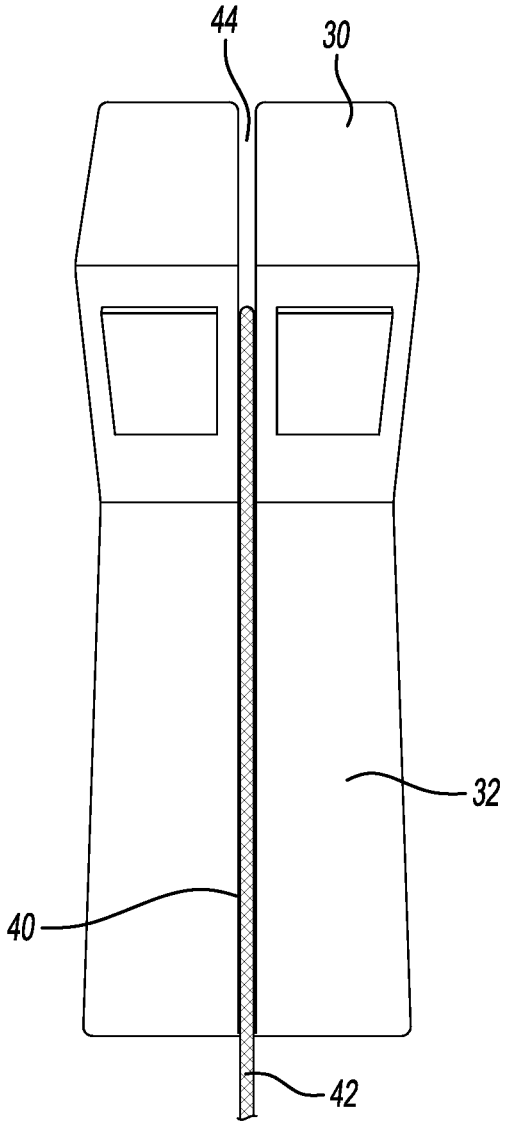
FIG. 9 illustrates a front view of a mason line fastener having a mason line extending through the slot and inserted into the groove.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A mason line fastener 20 is generally presented. The mason line fastener 20 may be configured to connect to a corner of a brick, stone, block, or the like ("block") and to hold a mason line taut in a desired position relative to an intended wall edge.

The mason line fastener 20 may be formed of any appropriate material, such as plastic. In an embodiment, the mason line fastener 20 may be formed of a light weight material, such as wood or plastic, and be design with weight reduction features, such as material cutouts. The reduced weight may help to reduce the risk of injury or damage should the mason line fastener 20 be dislodged from connection to a block corner while the line is taut or under force or pressure.

The mason line fastener 20 may comprise a first outer edge 22 and a second outer edge 24. The first and second outer edges 22, 24 may be generally flat or linear and may intersect at a first corner 26. In an embodiment, illustrated in the FIGS, the first and second outer edges 22, 24 may intersect at a first outer angle 28, such as a 90 degree angle to form a squared or right angle outer surface. The first outer edge 22 may be longer than the second outer edge 24 to yield a non-symmetrical or non-square shape of the mason line fastener 20.

The mason line fastener 20 may further include a third outer edge 30. The third outer edge 30 may be adjacent to the second outer edge 24 and form a second corner therewith. The second and third outer edges 24, 28 may be arranged at a 90 degree angle with respect to each other to create a third squared edge.

The mason line fastener 20 may include a first inner surface 32 and a second inner surface 34. The first and second inner surfaces 32, 34 may intersect at an inner angle 36, such as an approximately 90 degree angle as shown in the FIGS. The inner angle 36 may be offset from the first outer angle 28. As used herein, the term "offset" in reference to the relationship of the two angles 28, 36 may be defined as meaning that the first inner surface 32 and the first outer edge 22 are neither parallel or perpendicular, and similarly the second inner surface 34 and the second outer edge 24 are neither parallel or perpendicular.

In an embodiment, the first inner surface 32 may be offset from the first outer edge 22 at an angle between 25 degrees and 60 degrees. However, it will be appreciated that the offset between the inner angle 36 and the outer angle 28 may be any appropriate offset.

The first inner surface 32 may include a groove 40. The groove 40 may extend linearly along the entire length of the first inner surface 32 and through the second inner surface 34, all the way through the second outer edge 24. The groove 40 may be sized and shaped to hold a string, such as a mason line 42, therein.

A slot 44 may extend from an outer edge of the mason line fastener 20 to the groove 40. The slot 44 may be located adjacent to and up to the groove 40 and may generally extend through and bisect the third outer edge 30. The slot 44 may be configured to allow a mason line to be threaded therethrough to be set within the groove 40. As described above, the groove 40 may extend linearly to and through the second outer edge 24, and the slot 44 may extend up to and align with the groove 40.

The mason line fastener 20 may include an outer groove 46 in the second outer edge 24. The outer groove 46 may be generally in line with the slot 44 and adjacent to the groove 40, and may bisect the second outer edge 34.

The outer groove 46 may connect to and intersect a corner groove 48 positioned around the first corner 26. The corner groove 48 may extend laterally across the first and second outer edges 22, 24 and may connect together to form a loop by extending diagonally along the sides of the mason line fastener 20 between the first and second outer edges 22, 24.

A triangular groove 50 may extend from the lateral portion of the corner groove 48, forming two angled lines that together with the lateral portion of the corner groove 48 may form a triangle. The tip of the triangular groove 50 may be positioned at or near the first corner 26 and may connect to the outer groove 46.

The mason line fastener 20 may include one or more non-slip pads 52. The non-slip pads 52 may be positioned on the first and/or second inner surface 32, 34 and may be configured to assist in keeping the mason line fastener 20 in place when positioned against a block. The non-slip pads 52 may be formed of any appropriate material, such as rubber, or the like. Blocks are often wet or icy due to elements of a job and therefore the non-slip pads provide additional friction to hold the mason line fastener 20 in place.

In use, a mason line 42 may be inserted into the groove 40 and threaded through the slot 44. The mason line 42 may be inserted into the outer groove 46 and wound around the corner groove 48 and/or triangular groove 50 to prevent the mason line 42 from slipping free when held under tension.

The mason line fastener 20 may be abutted against a corner of a block, such as a bullnose block or a block having a radiused or curved corner. The first and second inner surfaces 32, 34 may be arranged to engage adjacent sides of the block with the non-slip pads 52 abutting at least one of the block sides. The mason line 42 may be held taut to provide a line to be used by a mason for aligning new blocks to be placed in the wall.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, I claim:

1. A mason line fastener configured to connect to a corner of a block and hold a mason line in a desired location relative to a wall to be built, the mason line fastener comprising:

a first outer edge;

a second outer edge adjacent to and forming a first outer angle with the first outer edge, wherein the first and second outer edges intersect at a first corner;

a first inner surface and second inner surface forming an inner angle, wherein the inner angle is offset from the first outer angle;

a groove in the first inner surface, wherein the groove extends along a length of the first inner surface and through the second inner surface and through the second outer edge;

a second groove located in the second outer edge, wherein the second groove connects to the groove;

a third groove extending around the first corner; and a triangular groove in the first outer edge, wherein one side of the triangular groove is shared with a third groove, the triangular groove extends from the lateral portion of the third groove, the triangular groove connected to the third groove.

2. The mason line fastener of claim 1, further comprising a slot located adjacent to the groove, the slot extending through the second inner surface and the second outer edge.

3. The mason line fastener of claim 2, wherein the slot bisects the second inner surface and the second outer edge.

4. The mason line fastener of claim 1, further comprising a triangular groove in the first outer edge, wherein one side of the triangular groove is shared with a third groove.

5. The mason line fastener of claim 1, further comprising one or more non-slip pads located on the second inner surface.

6. The mason line fastener of claim 1, wherein the mason line fastener is formed of molded plastic.

7. A method of positioning a mason line, the method comprising:

providing a mason line fastener, the mason line fastener comprising:

a first outer edge and a second outer edge adjacent to and forming a first corner having a first outer angle with the first outer edge;

a first inner surface and second inner surface forming an inner angle, wherein the inner angle is offset from the first outer angle;

a groove in the first inner surface, wherein the groove extends from an intersection between the first inner surface and the first outer edge through the second inner surface and through the second outer edge;

a second groove located in the second outer edge, wherein the second groove connects to the groove;

a third groove extending around the first corner; and a triangular groove in the first outer edge, wherein one side of the triangular groove is shared with a third groove, the triangular groove extends from the lateral portion of the third groove, the triangular groove connected to the third groove, positioning the first inner surface and second inner surface against adjacent sides of a block;

providing a mason line and winding the mason line around a portion of the mason line fastener;

positioning the mason line within the groove, the second groove, and the third groove; and wherein the mason line is held taut to define an edge of a wall to be built.

8. The method of claim 7, wherein a corner of the block formed by the intersection of adjacent walls is curved.

9. The method of claim 7, wherein winding the mason line around a portion of the mason line fastener includes winding the mason line around a groove extending around the first corner.

10. The method of claim 7, wherein winding the mason line around a portion of the mason line fastener includes winding the mason line around a triangular groove.

11. The method of claim 7, wherein the mason line fastener further comprises a slot located adjacent to the groove, the slot extending through the second inner surface and the second outer edge.

12. The method of claim 11, further comprising the step of threading the mason line through the slot.

* * * * *